US006848268B1

(12) United States Patent
Memory et al.

(10) Patent No.: US 6,848,268 B1
(45) Date of Patent: Feb. 1, 2005

(54) $CO_2$ COOLING SYSTEM

(75) Inventors: Stephen B. Memory, Kenosha, WI (US); Jianmin Yin, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/718,275

(22) Filed: Nov. 20, 2003

(51) Int. Cl.[7] ..... F25B 41/00
(52) U.S. Cl. ..... 62/513; 62/510; 62/228.5
(58) Field of Search ..... 62/513, 510, 503, 62/228.5, 228.1, 222

(56) References Cited

U.S. PATENT DOCUMENTS

| | | | | |
|---|---|---|---|---|
| 1,408,453 | A | | 3/1922 | Goosmann |
| 2,467,078 | A | | 4/1949 | Cahenzli, Jr. |
| 2,482,171 | A | | 9/1949 | Gygax |
| 2,530,648 | A | | 11/1950 | Cahenzli, Jr. |
| 2,901,894 | A | | 9/1959 | Zearfoss, Jr. |
| 2,990,698 | A | | 7/1961 | Crotser |
| 3,128,607 | A | | 4/1964 | Kyle |
| 3,163,998 | A | | 1/1965 | Wile et al. |
| 3,246,482 | A | | 4/1966 | Harnish |
| 3,381,487 | A | | 5/1968 | Harnish |
| 3,421,339 | A | | 1/1969 | Volk et al. |
| 3,540,230 | A | | 11/1970 | Evans |
| 3,638,446 | A | | 2/1972 | Palmer |
| 3,668,883 | A | * | 6/1972 | Ruff et al. ..... 62/158 |
| 3,872,682 | A | | 3/1975 | Shook |
| 3,955,375 | A | | 5/1976 | Schumacher |
| 3,978,685 | A | | 9/1976 | Taylor |
| 5,205,131 | A | * | 4/1993 | Powlas ..... 62/203 |
| 5,245,836 | A | | 9/1993 | Lorentzen et al. |
| 5,531,080 | A | | 7/1996 | Hirahara et al. |
| 5,685,160 | A | | 11/1997 | Abersfelder et al. |
| 6,073,454 | A | | 6/2000 | Spauschus et al. |
| 6,112,547 | A | | 9/2000 | Spauschus et al. |
| 6,178,761 | B1 | | 1/2001 | Karl |
| 6,233,969 | B1 | | 5/2001 | Yamauchi et al. |
| 6,298,687 | B1 | | 10/2001 | Dienhart et al. |
| 6,343,486 | B1 | | 2/2002 | Mizukami |
| 6,457,325 | B1 | * | 10/2002 | Vetter ..... 62/473 |
| 6,460,358 | B1 | | 10/2002 | Hebert |
| 6,568,198 | B1 | * | 5/2003 | Tadano et al. ..... 62/217 |

* cited by examiner

*Primary Examiner*—Melvin Jones
(74) *Attorney, Agent, or Firm*—Wood, Phillips, Katz, Clark & Mortimer

(57) ABSTRACT

A cooling system including an evaporator, a suction line, a two stage compressor, a gas cooler and a capillary tube. The suction line receives gaseous or two phase refrigerant from the evaporator, the compressor receives the gaseous or two phase refrigerant from the suction line, and the gas cooler cools compressed refrigerant discharged from the compressor. The capillary tube carries refrigerant from the gas cooler to the evaporator, and the suction line may include two straight portions with two portions of the capillary tube helically wound therearound, with a bypass valve around the capillary tube, and an accumulator between the suction line portions. An inter-cooler is between stages of the compressor, and a pan collects water condensate from the air side of the evaporator, and the refrigerant tube carries cooled refrigerant from the gas cooler through the pan. A controller selectively turns the compressor on and off based on temperature or pressure sensed by a sensor.

23 Claims, 4 Drawing Sheets

$CO_2$ COOLING SYSTEM

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to cooling systems, and more particularly to transcritical cooling systems.

BACKGROUND OF THE INVENTION AND TECHNICAL PROBLEMS POSED BY THE PRIOR ART

Transcritical cooling systems are known in the art. Such systems typically cyclically compress, cool and evaporate a refrigerant flowing through a first side of an evaporator, where heat is absorbed during evaporation from a second side of the evaporator to cool fluid on the second side. Such systems may be used, for example, for automotive air conditioning.

In an exemplary system, there is a compressor, a condenser, and an evaporator, with a counterflow heat exchanger for exchanging heat between the fluid passing from the condenser to the evaporator and the fluid passing from the evaporator to the compressor. As shown in U.S. Pat. No. 5,245,836, an integrated storage segment (liquid separator/receiver) is required in the closed fluid circuit between the evaporator and the compressor. U.S. Pat. Nos. 2,467,078, 2,530,648 and 2,990,698 illustrate combinations of heat exchanger, accumulator and metering device which may be used with such cooling systems.

The present invention is directed toward improving such transcritical cooling systems.

SUMMARY OF THE INVENTION

The present invention is an improvement upon a cooling system including an evaporator, a suction line, a compressor, a gas cooler and a capillary tube. The evaporator receives refrigerant in a liquid state from a capillary tube and is adapted to evaporate the refrigerant to a gaseous state. The suction line receives refrigerant output from the evaporator. The compressor receives the refrigerant from the suction line and is adapted to compress the refrigerant. A gas cooler is adapted to cool compressed refrigerant discharged from the compressor. The system also includes a capillary tube adapted to carry cooled refrigerant from the gas cooler to the evaporator, where the suction line and the capillary tube are disposed adjacent each other for heat exchange therebetween.

In one aspect of the present invention relating to cooling systems such as described above, the compressor is a two stage compressor, having a first stage receiving the refrigerant from the suction line and outputting compressed refrigerant to an inter-cooler, and a second stage receiving the refrigerant from the inter-cooler and outputting compressed refrigerant.

In different advantageous forms of this aspect of the invention, the capillary tube wraps around said suction line the refrigerant is carbon dioxide, and/or the cooling system is transcritical.

In another aspect of the present invention relating cooling systems such as described above, a pan is adapted to collect water condensate from the air side of the evaporator, and a refrigerant tube is adapted to carry cooled refrigerant from the gas cooler through the pan in heat exchange relation with the collected water condensate.

In different advantageous forms of this aspect of the invention, the refrigerant is carbon dioxide, and/or the cooling system is transcritical.

In still another aspect of the present invention relating cooling systems such as described above, a sensor is adapted to sense one of air temperature, suction line temperature, or suction line pressure, and a controller is adapted to selectively turn the compressor on and off based on the one temperature or pressure sensed by the sensor.

In one advantageous form of this aspect of the invention, the controller turns the compressor on to compress the refrigerant only when the sensor senses air temperature above a selected level.

In yet another aspect of the present invention relating cooling systems such as described above, the suction line includes first and second substantially parallel straight cylindrical portions connected in series, and the capillary tube includes first and second helically wound portions connected in series. The first helically wound portion is wrapped around the suction line second straight cylindrical portion and the second helically wound portion is wrapped around the suction line first straight cylindrical portion.

In one advantageous form of this aspect of the invention, a bypass safety valve is provided between an inlet to the first helically wound portion of the capillary tube and an outlet from the second helically wound portion of the capillary tube. The bypass safety valve opens responsive to a pressure differential between the inlet to the first helically wound portion of the capillary tube and the outlet from the second helically wound portion of the capillary tube. In another advantageous form of this aspect of the invention, the suction line includes a U-shaped portion connecting the first and second cylindrical portions of the suction line.

In still another advantageous form of this aspect of the invention, an accumulator is provided between the first and second cylindrical portions of the suction line.

In yet another advantageous form of this aspect of the invention, the refrigerant is $CO_2$ and the capillary tube is an expansion device for the cooled $CO_2$ refrigerant.

In a still further aspect of the present invention relating to cooling systems such as described above, the suction line includes a straight cylindrical portion with an accumulator between the evaporator and the suction line straight portion. The accumulator includes a phase separation chamber having an input for refrigerant from the evaporator and an outlet for refrigerant from which oil and liquid droplets have been separated in the phase separation chamber, an accumulator including a discharge opening for discharging oil to return the oil to the system, and a vertical pipe between the phase separation chamber and the accumulator.

In an advantageous form of this aspect of the invention, a second vertical pipe between the phase separation chamber and the accumulator is provided, with the second vertical pipe adapted to hold a selected volume of refrigerant charge.

According to a further aspect of the present invention relating cooling systems such as described above, a bypass tube is provided around the capillary tube, where the bypass tube includes an inter-bleeding valve adapted to open responsive to pressure above a selected level in the refrigerant discharged from the gas cooler.

In advantageous forms of this aspect of the invention, the selected level is above normal operating pressures, and/or the refrigerant is carbon dioxide.

According to a still further aspect of the present invention relating cooling systems such as described above, the various above described aspects of the invention may be jointly incorporated in the above described cooling system.

DETAILED DESCRIPTION OF THE INVENTION

Figure 1:
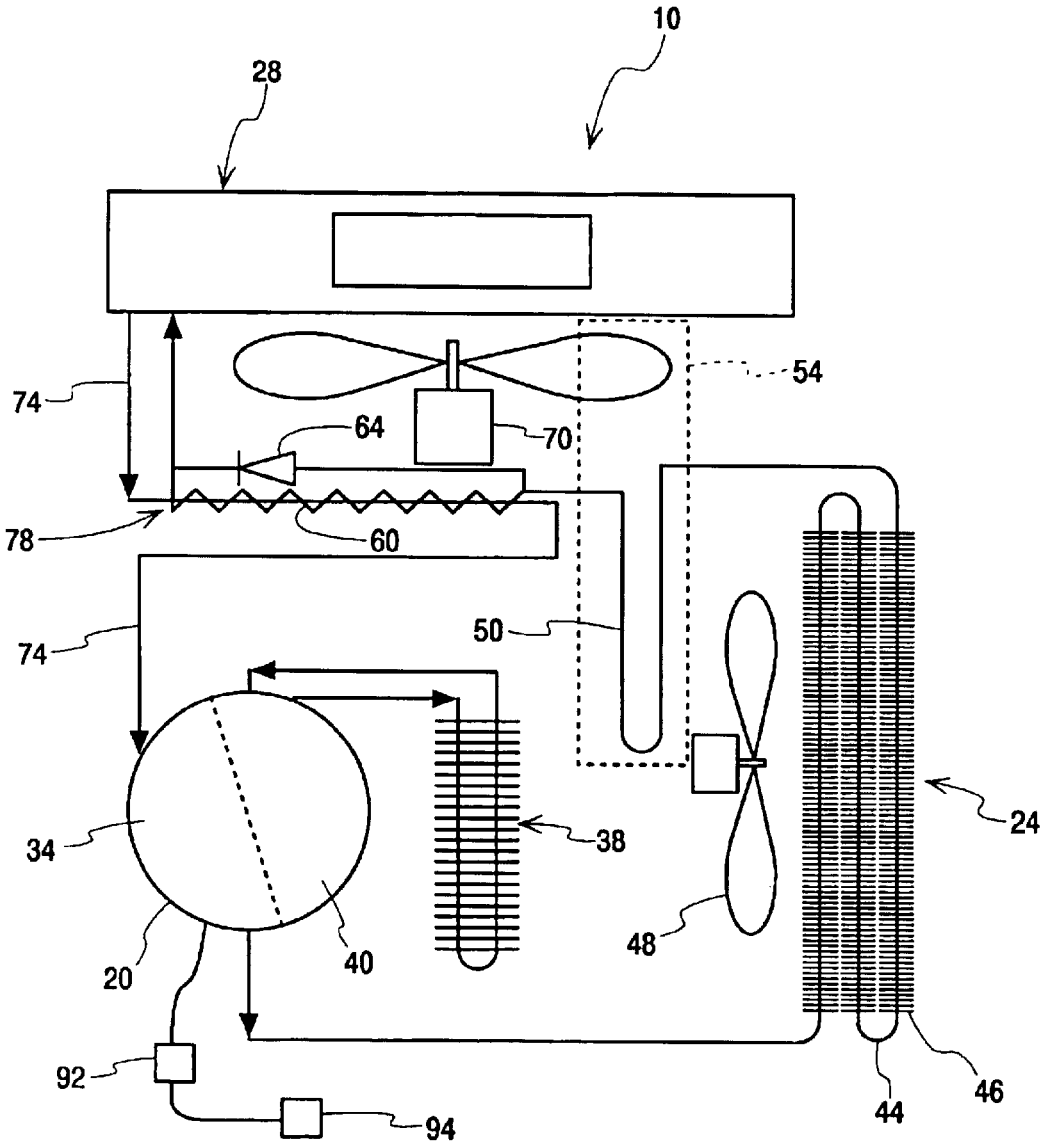
FIG. 1 is a schematic view of a cooling system embodying an aspect of the present invention.

An exemplary embodiment of a cooling system 10 embodying the present invention is shown in FIG. 1, including a compressor 20, a counterflow gas cooler 24, and an evaporator 28.

In the advantageous embodiment illustrated, the compressor 20 is a two-stage compressor, in which gaseous refrigerant is input-into the first stage 34 of the compressor 20, which compresses the refrigerant. The compressed refrigerant from the compressor first stage 34 is output to an optional inter-cooler 38, where it may be suitably cooled, after which it is input to the second stage 40 of the compressor 20, which further compresses the gaseous refrigerant. The first and second stages 34, 40 of the compressor 20 are represented schematically in FIG. 1.

While carbon dioxide ($CO_2$) may be used as the refrigerant according to one advantageous aspect of the invention, particularly in transcritical cooling systems, it should also be appreciated that still other working fluids could be used with the present invention including, for example, other refrigerants.

The refrigerant compressed by the second stage 40 of the compressor 20 is discharged to the gas cooler 24. The gas cooler 24 may be any suitable form for cooling and/or condensing the gas which passes through the tubes of the cooler 24. For example, a gas cooler 24 having a serpentine tube 44 with fins 46 between runs of the tube 44 is schematically shown in FIG. 1 for illustration purposes. The gaseous refrigerant in the tube 44 is cooled via heat transfer with environmental air which may be advantageously blown over the air-side of the tubes 44 and fins 46, as by the schematically illustrated fan 48. However, it should be understood that single pass or multipass condenser structures having round tubes and plate fins, or having microchannel tubes and serpentine fins, may also be advantageously used with the present invention, as well as any other heat exchanger suitable to the environment in which the system 10 is to be used for cooling gaseous refrigerant discharged from the compressor.

The inter-cooler 38 may be advantageously integrated with the gas cooler 24, albeit with separate refrigerant paths, whereby the refrigerant may be cooled via air blown (as by fan 48) over tubes containing refrigerant discharged from the compressor first stage 34 (i.e., tubes in the inter-cooler 38) and refrigerant discharged from the compressor second stage 38 (i.e., tubes 44). In an advantageous configuration, the intercooler 38 and gas cooler 24 may be assembled together with microchannel tubes and serpentine fins.

The cooled gaseous refrigerant discharged from the gas cooler 24 passes through a refrigerant tube 50 in a water collecting pan/cooler 54, for further cooling of the refrigerant leaving the gas cooler 24 as further described hereafter.

The refrigerant tube 50 is split into two paths after the water collecting pan 54, with one path consisting of a capillary tube 60 and the other having an inter-bleeding valve 64. The capillary tube 60 has a small diameter as to throttle the refrigerant, causing the refrigerant to expand to a two phase state at the outlet of the capillary tube 60 while also controlling the flow rate of refrigerant through the system 10. Further, as described hereafter, the refrigerant is also cooled in the capillary tube 60. The inter-bleeding valve 64 is adapted to open at a pressure which is above the normal operating pressure of the system 10, so as to allow for bypassing around the capillary tube 60 during extremely high pressures, such as pressure spikes which can occur during start up of the system 10.

The two phase refrigerant discharged from the capillary tube 60 then passes to the evaporator 28, where the liquid refrigerant is suitably evaporated to a gaseous state. For example, as illustrated, warmer environmental air may be blown over the evaporator 28 by a fan 70, whereby heat from the air is absorbed by the cooler refrigerant in the evaporator 28, causing the refrigerant to evaporate into a gaseous state.

Condensation of water in the warmer environmental air on the evaporator 28 is collected in the water collecting pan 54, which water serves to cool the refrigerant passing through the refrigerant tube 50 submersed in the water in the pan 54 as previously noted.

The gaseous refrigerant is discharged from the evaporator 28 through a suction line tube 74 which is connected to the input of the first stage 34 of the compressor 20, with the refrigerant then cycling through the system 10 again as described above.

Further, the suction line tube 74 cooperates with the capillary tube 60 so as to form a suction line heat exchanger 78. Specifically, in the configuration illustrated in FIG. 1, the capillary tube 60 is helically wound around the suction line tube 74 whereby heat is advantageously exchanged between refrigerant in the tubes 60, 74.

A single controller 92 may be advantageously used to control the system 10 by simply turning the compressor 20 on and/or off responsive to a sensed condition. For example, a suitable sensor 94 such as a simple thermocouple may be provided to sense ambient air temperature, with the controller 92 responsive to the sensed temperature to turn on the compressor 20 (and fans 48, 70) when the temperature rises above a selected level. The sensor 94 may alternatively be used to sense different conditions, such as temperature or pressure in the suction line tube 74.

FIGS. 2–7 variously further illustrate advantageous suction line heat exchangers such as may be advantageously used in connection with the present invention.

Figure 2:
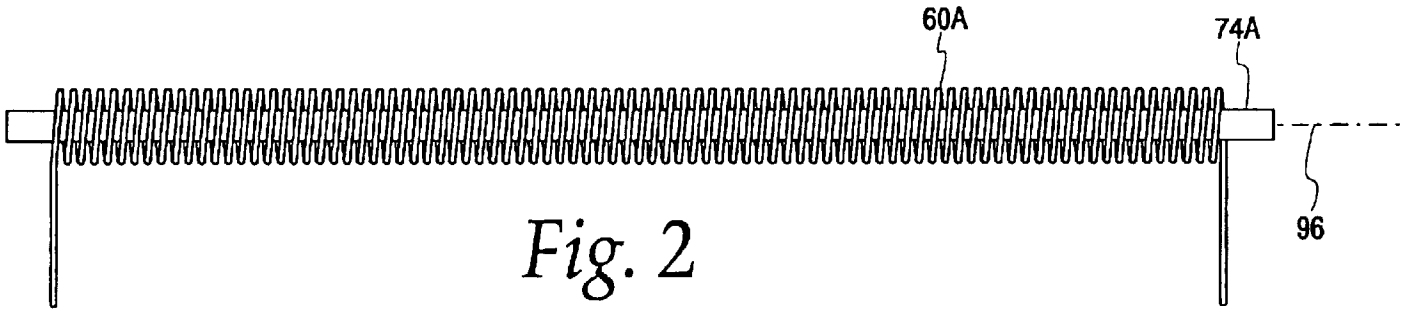
FIG. 2 illustrates a first embodiment of a suction line heat exchanger which may be used with the present invention.
Figure 3:
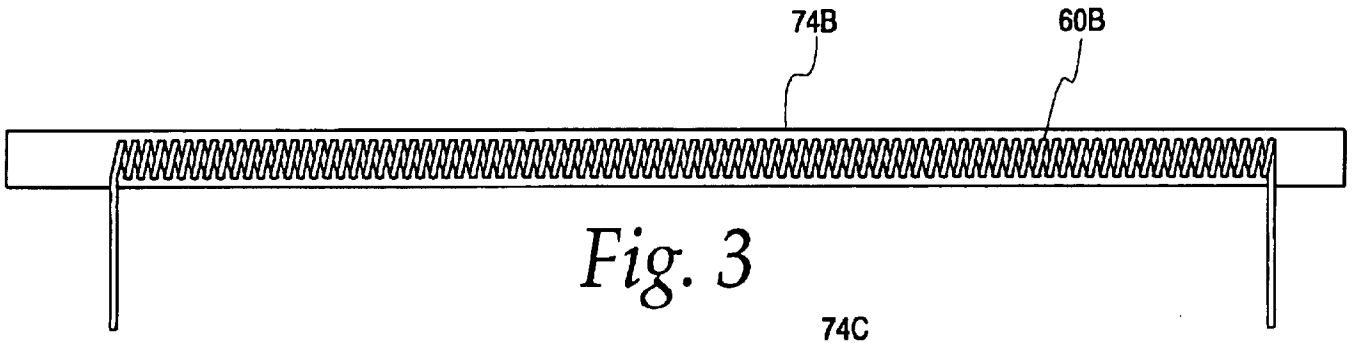
FIG. 3 illustrates a second embodiment of a suction line heat exchanger which may be used with the present invention.
Figure 4:
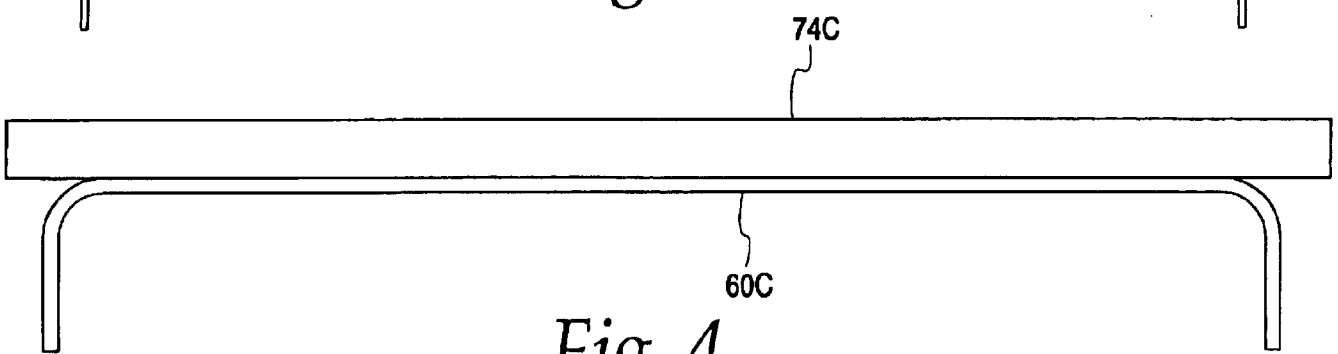
FIG. 4 illustrates a third embodiment of a suction line heat exchanger which may be used with the present invention.

As generally illustrated in FIGS. 2–4, a suction line heat exchanger may be provided in which the suction line tube 74 includes a generally straight portion which is cylindrical about an axis 96. The capillary tube 60 may be variously positioned relative to the suction line tube 74 so that heat is exchanged between the tubes 74, 60 as previously described.

For example, in FIG. 2, the capillary tube 60*a* is helically wound around the suction line tube 74*a*, where the helical winding of the capillary tube 60*a* is generally around the axis 96 of the cylindrical suction line tube 74*a*. Adequate operation, including desired heat exchange, can be provided for a typical application of the cooling system 10 of the present invention by a compact structure, using a capillary tube 60*a* which is less than two (2) mm in diameter wrapped around only about twenty (20) inches of the suction line tube 74*a*.

Alternatively, as shown in FIG. 3, the capillary tube 60*b* may also be helically wound but with the helically wound portion inside of the suction line tube 74*b*. Yet another simple alternative, shown in FIG. 4, is for the capillary tube 60*c* to also be straight and positioned adjacent (or inside) the suction line tube 74*c*.

Cooling systems 10 such as shown in FIG. 1 may use the FIG. 24 suction line heat exchangers. However, various advantageous new suction line heat exchangers are also disclosed herein and may also be advantageously used with cooling systems embodying the present invention, as well as others.

Figure 5:
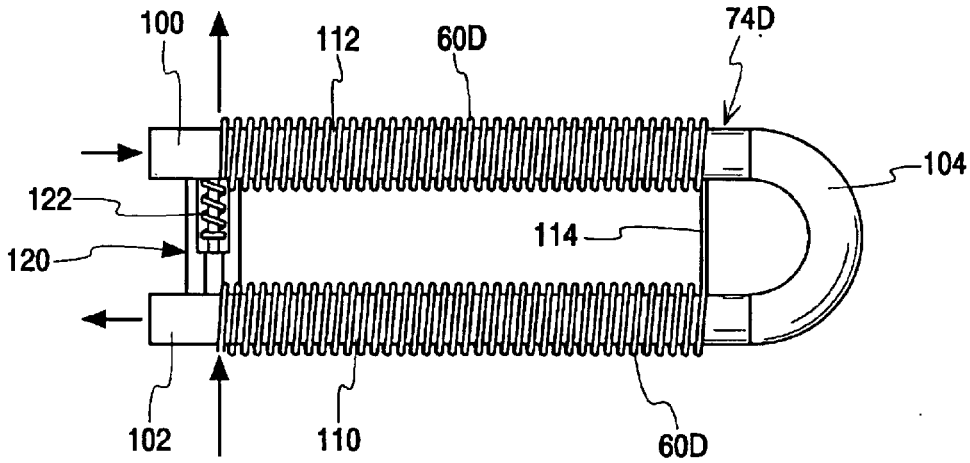
FIG. 5 illustrates a suction line heat exchanger embodying another aspect of the present invention.

FIG. 5 discloses one such advantageous new suction line heat exchanger. In this embodiment, the suction line tube 74*d* includes first and second substantially parallel straight cylindrical portions 100, 102 connected in series, with the first straight portion 100 receiving gaseous liquid from the evaporator 28, and the second straight portion 102 receiving gaseous refrigerant from the first straight portion 100 through a U-shaped portion 104. Gaseous refrigerant is output from the second straight portion 102 to the compressor 20.

The capillary tube 60*d* may carry cooled refrigerant to the evaporator 28, and includes first and second helically wound portions 110, 112 connected in series so that the second helically wound portion 112 receives cooled refrigerant from the first helically wound portion 110 through a connecting capillary tube portion 114. The first helically wound portion 110 is wrapped around the suction line second straight cylindrical portion 102 and the second helically wound portion 112 is wrapped around the suction line first straight cylindrical portion 100.

A suitable safety valve 120 is provided between the inlet and outlet of the capillary tube 60*d*, where such safety valve 120 may function such as the inter-bleeding valve 64 as described in connection with FIG. 1. That is, the safety valve 120 is adapted to open at a pressure which is above the normal operating pressure of the system 10 (e.g., over 120 bar) so as to allow for bypassing around the capillary tube 60*d* during extremely high pressures.

In the illustrated embodiment, the valve 120 includes a spring 122 with a selected strength sufficient to maintain the valve 120 seated unless the pressure on the high side (i.e., the pressure at the inlet to the capillary tube 60*d*) is at least a selected level, in which case the pressure will be sufficient to overcome the force of the spring 122 and unseat the valve 120. Unseating of the valve 120 will allow refrigerant to by-pass the capillary tube 60*d* until the pressure returns below the selected maximum level. As previously indicated, such a pressure spike may occur during start up of a cooling system. During normal operation, the valve 120 will remain seated (closed). It should be understood that the particular valve structure illustrated in FIG. 5 is only exemplary, however, and that any valve structure suitable for the above described operation may be advantageously used with the illustrated embodiment.

It should be appreciated that the suction line heat exchanger illustrated in FIG. 5 may be advantageously used in many applications, particularly those in which space is at a premium, as the illustrated heat exchanger may maximize heat exchange in a relatively short (narrow) space.

Figure 6:
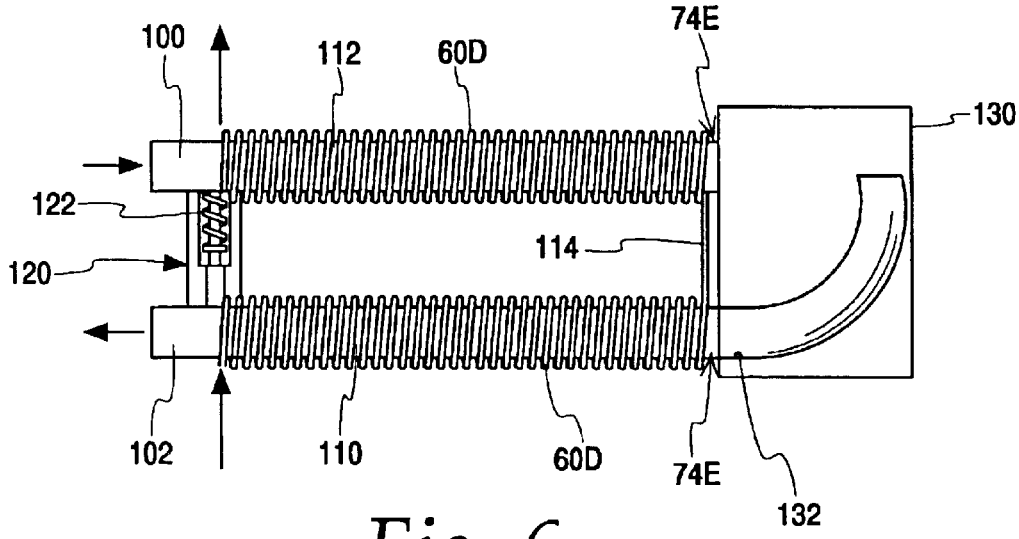
FIG. 6 illustrates a modified suction line heat exchanger with an accumulator.
Figure 7:
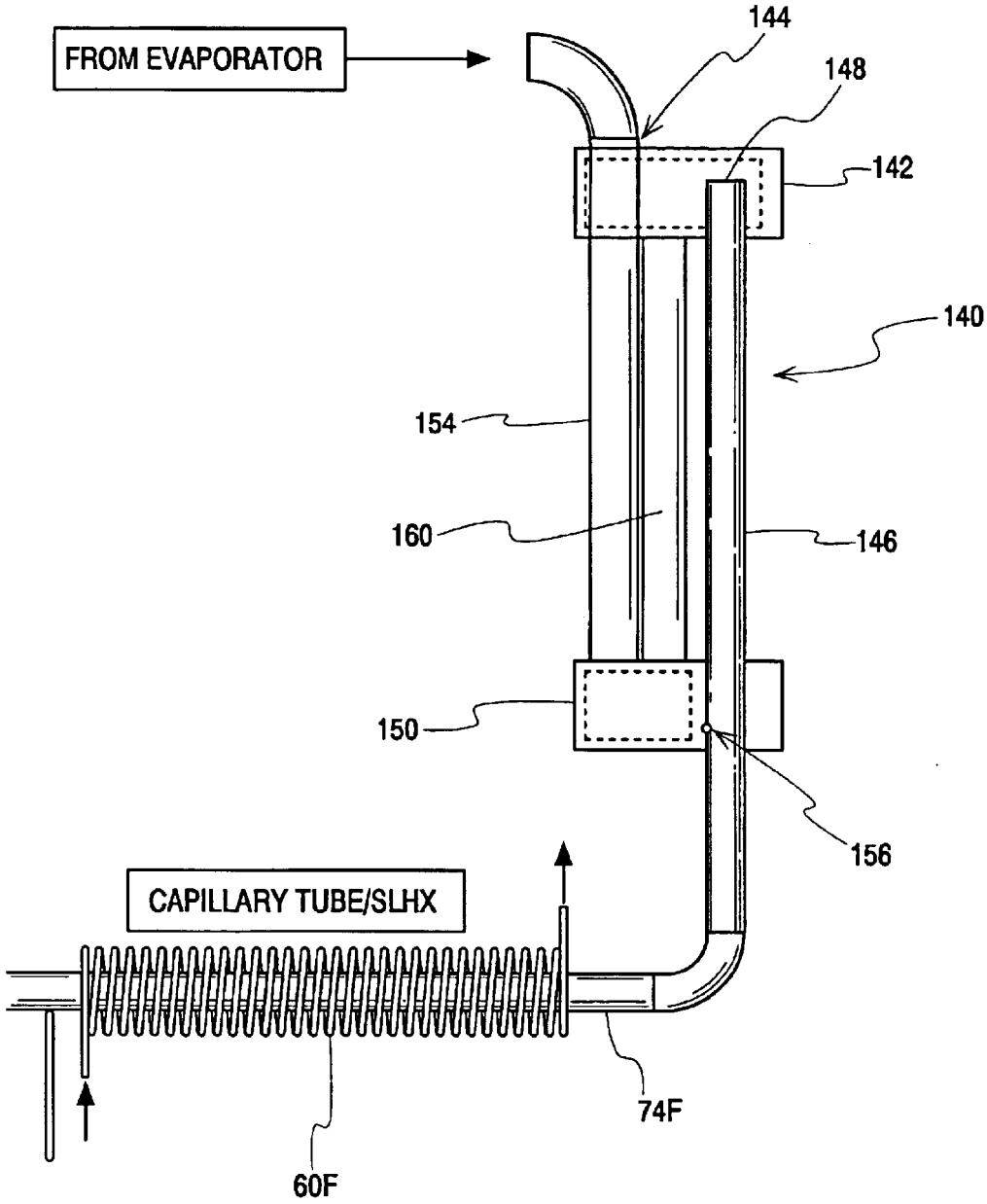
FIG. 7 illustrates an alternative suction line heat exchanger and accumulator.

FIG. 6 illustrates yet another embodiment of an advantageous suction line heat exchanger. In this illustrated embodiment, the suction line heat exchanger is substantially similar to the FIG. 5 embodiment except that the suction line tube 74*e* includes an in-line accumulator 130 with an oil return hole 132 in place of the U-shaped portion of FIG. 5. It should be appreciated that, like the FIG. 5 embodiment, the FIG. 6 embodiment may also be advantageously used in many applications, particularly those in which space is at a premium, with the illustrated heat exchanger maximizing heat exchange in a relatively short (narrow) space FIG. 7 illustrates still another embodiment of an advantageous structure between the evaporator 28 and compressor 20 of a cooling system 10, including a suction line heat exchanger. Specifically, the heat exchanger is illustrated as being such as shown in FIG. 2, with the capillary tube 60*f* helically wound around a straight portion of the suction line tube 74*f*. However, it should be understood that the suction line heat exchanger of the FIG. 7 embodiment could be in still other suitable forms, such as those shown in FIGS. 3–5.

An accumulator 140 is provided between the suction line heat exchanger and the evaporator. Specifically, the accumulator 140 includes a separation chamber or housing 142 with an inlet 144 receiving refrigerant from the evaporator. A vertical suction line tube 146 is connected at its lower end to the portion of the suction line tube 74*f* in the suction line heat exchanger (with the capillary tube 60*f*), and on its upper end 148 is open inside the separation housing 142 and spaced from the bottom of the housing 142. Accordingly, gaseous or two phase refrigerant from the evaporator 28 enters the separation housing 142 at inlet 144, oil and liquid droplets in the refrigerant will dropout of the refrigerant so that the refrigerant which enters the upper end 148 of the suction line tube 146 to exit the housing 142 will have a desirably reduced amount of liquid droplets mixed therein.

An accumulator housing 150 is disposed beneath the separation housing 142 and is connected thereto by a vertical pipe 154. Oil and liquid droplets which are separated from the refrigerant will drain down through the vertical pipe 154 to the accumulator housing 150, and from there may be suitably recirculated via an oil return hole 156 in the accumulator housing 150. A second vertical pipe 160 is also illustrated as connecting the separation housing 142 and accumulator housing 150. However, it should be appreciated that still more vertical pipes could also be included within the scope of the present invention.

The vertical pipes 154, 160 not only connect the housings 142, 150, but also provide storage volume for oil and system charge. It should be appreciated that through the use of such pipes 154, 160, the accumulator 140 may be readily adapted for different requirements. For example, in an environment where an increased storage volume may be required, this may be provided by simply increasing the length of the tubes 154, 160 and correspondingly increasing the spacing between the housings 142, 150. By contrast, increasing the volume per unit height ratio could require use of thicker materials, and therefore increase the weight of the structure. Increased weight can make a structure unacceptable in some applications where weight is important.

The second vertical pipe 160 as illustrated in FIG. 7 is straight. However, it should be appreciated that it would be within the scope of the present invention to use other vertically extending pipe structures which provide storage volume for charge and separated oil, including more than two such pipes, and different shaped pipes, such as a pipe which is helically wound around the vertical suction line tube 146 and/or other vertical pipes between the housings 142, 150.

It should be appreciated that advantageous cooling may be efficiently and reliably provided with the above described compact cooling system 10. It should further be appreciated that advantageous cooling may be efficiently and reliably provided through the use of compact, low weight suction line heat exchangers such as also described above.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A cooling system, comprising:

an evaporator;

a suction line for refrigerant output from said evaporator;

a two stage compressor adapted to compress said refrigerant from said suction line, said compressor having a first stage receiving said-gaseous refrigerant from said suction line and outputting compressed gaseous refrigerant to an inter-cooler, and a second stage receiving said gaseous refrigerant from said inter-cooler and outputting compressed gaseous refrigerant;

a gas cooler integrated with said inter-cooler, said gas cooler adapted to cool compressed refrigerant discharged from said compressor second stage;

a capillary tube adapted to carry cooled refrigerant from said gas cooler to said evaporator;

wherein said suction line and said capillary tube are disposed adjacent each other for heat exchange therebetween.

2. The cooling system of claim 1, wherein said capillary tube wraps around said suction line.

3. The cooling system of claim 1, wherein said refrigerant comprises carbon dioxide.

4. The cooling system of claim 1, wherein said cooling system is transcritical.

5. A cooling system, comprising:

an evaporator having an air side on which water condensation occurs;

a pan adapted to collect water condensate from the air side of said evaporator, a suction line for refrigerant output from said evaporator;

a compressor receiving said refrigerant from said suction line and adapted to compress said refrigerant;

a gas cooler adapted to cool compressed refrigerant discharged from said compressor, a refrigerant tube adapted to carry cooled refrigerant from said gas cooler through said pan in heat exchange relation with said collected water condensate;

a capillary tube adapted to carry cooled refrigerant from said refrigerant tube to said evaporator;

wherein said suction line and said capillary tube are disposed adjacent each other for heat exchange therebetween.

6. The cooling system of claim 5, wherein said refrigerant comprises carbon dioxide.

7. The cooling system of claim 5, wherein said cooling system is transcritical.

8. A cooling system, comprising:

an evaporator;

a suction line for refrigerant output from said evaporator;

a compressor receiving said refrigerant from said suction line and adapted to compress said refrigerant;

a gas cooler adapted to cool compressed refrigerant discharged from said compressor;

a capillary tube adapted to carry cooled refrigerant from said gas cooler to said evaporator;

a sensor adapted to sense one of external air temperature, suction line temperature, or suction line pressure; and a controller adapted to selectively turn said compressor on and off based on the one temperature or pressure sensed by said sensor;

wherein said suction line and said capillary tube are disposed adjacent each other for heat exchange therebetween.

9. The cooling system of claim 8, wherein said controller turns said compressor on to compress said gaseous refrigerant only when said sensor senses external air temperature above a selected level.

10. A cooling system, comprising:

an evaporator;

a suction line for refrigerant output from said evaporator, said suction line including first and second substantially parallel straight cylindrical portions connected in series whereby said second straight cylindrical portion receives refrigerant from said first straight cylindrical portion;

a compressor receiving said refrigerant from said suction line and adapted to compress said refrigerant;

a gas cooler adapted to cool compressed refrigerant discharged from said compressor, and a capillary tube adapted to carry cooled refrigerant to said evaporator, said capillary tube including first and second helically wound portions connected in series whereby said second helically wound portion receives cooled refrigerant from said first helically wound portion, said first helically wound portion being wrapped around said suction line second straight cylindrical portion and said second helically wound portion being wrapped around said suction line first straight cylindrical portion.

11. The cooling system of claim 10, further comprising a bypass safety valve between an inlet to said first helically wound portion of said capillary tube and an outlet from said second helically wound portion of said capillary tube, said bypass safety valve opening responsive to a pressure differential between said inlet to said first helically wound portion of said capillary tube and said outlet from said second helically wound portion of said capillary tube.

12. The cooling system of claim 10, wherein said suction line includes a U-shaped portion connecting said first and second cylindrical portions of said suction line.

13. The cooling system of claim 10, further comprising an accumulator between said first and second cylindrical portions of said suction line.

14. The cooling system of claim 10, wherein said refrigerant is $CO_2$ and said capillary tube is an expansion device for said cooled $CO_2$ refrigerant.

15. A cooling system, comprising:

an evaporator;

a suction line for refrigerant output from said evaporator, said suction line including a straight portion substantially cylindrical about an axis, and an accumulator between said evaporator and said suction line straight portion, said accumulator including a phase separation chamber having an input for refrigerant from said evaporator and an outlet for gaseous refrigerant from which oil and liquid droplets have been separated in said phase separation chamber, an accumulator including a discharge opening for discharging oil to return said oil to said system, a vertical pipe between said phase separation chamber and said accumulator, a compressor receiving said gaseous refrigerant from said suction line and adapted to comprises said gaseous refrigerant;

a gas cooler adapted to cool compressed refrigerant discharged from said compressor; and a capillary tube adapted to carry cooled refrigerant to said evaporator, said capillary tube including a portion helically wound around a central axis generally coinciding with said suction line straight portion axis;

wherein said suction line and said capillary tube are disposed adjacent each other for heat exchange therebetween.

16. The cooling system of claim 15, further comprising a second vertical pipe between said phase separation chamber and said accumulator, said second vertical pipe adapted to hold a selected volume of refrigerant charge.

17. A cooling system, comprising:

an evaporator;

a suction line for refrigerant output from said evaporator, a compressor receiving said refrigerant from said suction line and adapted to compress said refrigerant;

a gas cooler adapted to cool compressed refrigerant discharged from said compressor;

a capillary tube adapted to carry cooled refrigerant from said gas cooler to said evaporator; and a bypass tube around said capillary tube, said bypass tube including an inter-bleeding valve adapted to open responsive to a pressure differential above a selected level in said refrigerant discharged from said gas cooler;

wherein said suction line and said capillary tube are disposed adjacent each other for heat exchange therebetween.

18. The cooling system of claim 17, wherein said selected level is above normal operating pressures.

19. The cooling system of claim 17, wherein said refrigerant is carbon dioxide.

20. A cooling system, comprising:

an evaporator having an air side on which water condensation occurs;

a pan adapted to collect water condensate from the air side of said evaporator;

a suction line for refrigerant output from said evaporator, a two stage compressor adapted to compress said refrigerant, said compressor having a first stage receiving said refrigerant from said suction line and outputting compressed refrigerant to an inter-cooler, and a second stage receiving said refrigerant from said inter-cooler and outputting compressed refrigerant;

a gas cooler integrated with said inter-cooler, said gas cooler adapted to cool compressed refrigerant discharged from said compressor second stage;

a refrigerant tube adapted to carry cooled refrigerant from said gas cooler through said pan;

a capillary tube adapted to carry cooled refrigerant from said gas cooler to said evaporator;

a bypass tube around said capillary tube, said bypass tube including an inter-bleeding valve adapted to open responsive to a pressure differential above a selected level in refrigerant discharged from said refrigerant tube;

sensor adapted to sense one of air temperature, suction line temperature, or suction line pressure; and a controller adapted to selectively turn said compressor on and off based on the a temperature or pressure sensed by said sensor;

wherein said suction line and said capillary tube are disposed adjacent each other for heat exchange therebetween.

21. The cooling system of claim 20, wherein said capillary tube wraps around said suction line.

22. The cooling system of claim 20, wherein said refrigerant comprises carbon dioxide.

23. The cooling system of claim 20, wherein said cooling system is transcritical.

* * * * *